United States Patent [19]

Mazier

[11] 4,193,280

[45] Mar. 18, 1980

[54] APPARATUS FOR THE MANUFACTURE OF EXPANSION BELLOWS

[75] Inventor: Paul Mazier, Rillieux la Pape, France

[73] Assignee: Souplesse Fonctionnelle Systematique S.F.Z., Chassieu, France

[21] Appl. No.: 904,414

[22] Filed: May 10, 1978

[30] Foreign Application Priority Data

May 13, 1977 [FR] France ..... 77 16030

[51] Int. Cl.[2] ..... B21D 15/06

[52] U.S. Cl. ..... 72/59; 72/62

[58] Field of Search ..... 72/57–62

[56] References Cited

U.S. PATENT DOCUMENTS

| | | | |
|---|---|---|---|
| 2,842,182 | 7/1958 | Cate | 72/59 |
| 3,091,280 | 5/1963 | Yowell et al. | 72/59 |
| 3,704,983 | 12/1972 | Tellot | 72/59 |
| 4,065,947 | 1/1978 | Mazier | 72/59 |

*Primary Examiner*—Leon Gilden

*Attorney, Agent, or Firm*—Fleit & Jacobson

[57] ABSTRACT

An apparatus for the manufacture, by the hydroforming process, of expansion bellows for pipelines or the like, the apparatus being of the type comprising, for contracting longitudinally a sleeve to be formed, an actuating chamber of annular configuration defined by a rigid sleeve associated with the sleeve to be formed, a cylindrical skirt, and two sealing rings, one of which constitutes one of the supports for the sleeve to be formed. The apparatus is characterized in that the annular chamber is arranged, not outside, but inside the rigid sleeve, in such a manner that the hydroforming circuit is completely separate from the actuating circuit.

6 Claims, 3 Drawing Figures

APPARATUS FOR THE MANUFACTURE OF EXPANSION BELLOWS

The present invention relates to expansion bellows, with deformable corrugations, mounted in pipelines and the like industrial equipment, for the purpose of compensating for, and withstanding, deformation arising from fluctuations in the temperature of the fluid carried in the relevant pipelines.

It is known that one of the techniques commonly used in manufacturing bellows of this type is "hydroforming". In a process of this kind, also known as "hydrofolding", the operation starts with a sheet-metal sleeve of a length greater than that of the bellows to be obtained, the said length being, in fact, equal to the developed length of the cylindrical ends of the said bellows and of the deformable corrugations therebetween. A series of suitably spaced rings is applied to the outer wall of the sleeve, which is preferably provided with end-flanges, and it is then placed upon the fixed platen of a press. The interior of the sleeve is filled with a liquid which escapes at a controlled rate, and the press is operated in such a manner that the mobile platen is applied to one end of the assembly. The liquid inside the sleeve causes the metal to deform outwardly between the forming rings, so that the bellows is eventually shaped.

The power developed by the press is, of course, a function of the diameter of the sleeves to be formed, so much so that in order to produce large-diameter bellows, a rigid core, having a radius slightly smaller than that of the sleeve, must be placed inside the said sleeve in a manner such as to define, with the inside wall thereof, a narrow annular space. It is this annular space which is then filled with liquid, and the mobile press platen is applied only to the cross section thereof. It will be understood that only a relatively small amount of power is needed to form the bellows, regardless of the diameter of the original sleeve.

Although a process of this kind operates satisfactorily, it obviously requires bulky and complex equipment compatible only with plant manufacture. In order to overcome this disadvantage, U.S. Pat. No. 4,065,947 (Paul MAZIER) in particular, proposes a portable apparatus comprising, around a rigid sleeve constituting a core for hydroforming the bellows sleeve, an annular actuating chamber formed by the outside wall of the said rigid sleeve, a cylindrical skirt, and two sealing rings, one of which is integral with the said skirt and the other with the said rigid sleeve, one of the said two rings constituting one of the two end-supports for the bellows sleeve.

It should be pointed out, however, that, in an apparatus of this kind, the two fluid circuits, to wit that of the hydroforming fluid and that of the hydraulic actuating fluid come into contact with the same outside wall of the rigid sleeve. Thus if these two fluids are not of the same nature (for example oil and water), serious operating problems may arise, especially in the event of leakage.

According to the present invention, this disadvantage is overcome by locating the annular actuating chamber, not outside the rigid hydroforming sleeve, but inside it, so that the two circuits are completely separated, the one from the other.

It will be noted, moreover that this arrangement makes it possible to fit thickness liners to the outside wall of the sleeve, so that bellows of slightly different diameters can be produced on the same basic piece of equipment.

In the drawing attached hereto:

Figure 1:
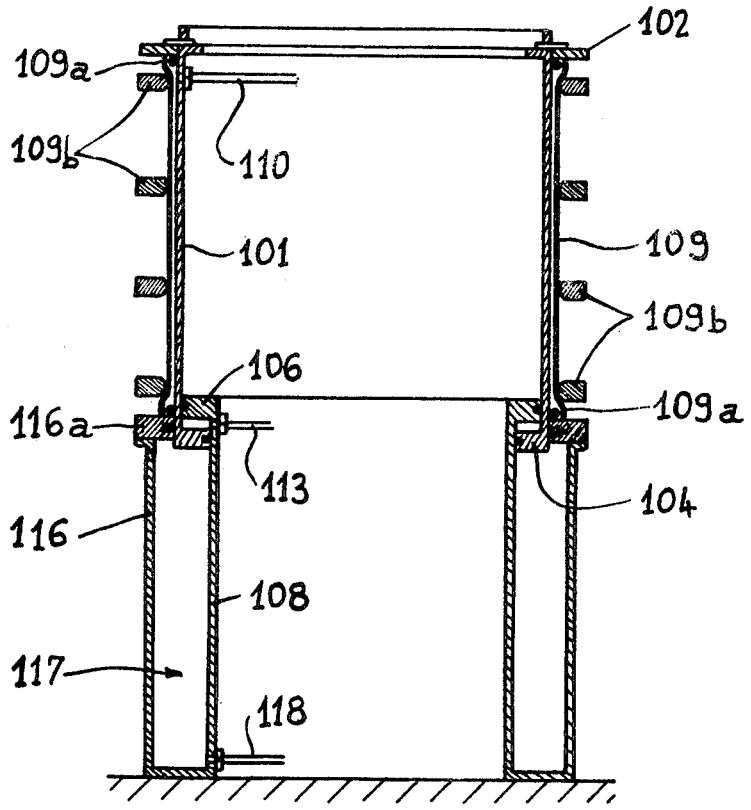
FIG. 1 is an axial cross section of the apparatus according to the invention.

In FIG. 1, the rigid sleeve of the apparatus consists of a piece of tube 101, the thickness and nature thereof being such as to avoid any risk of inopportune deformation in the course of the forming operation. The upper end of this sleeve 101 is provided with a ring 102 designed to provide support for upper flange 109*a* of bellows sleeve 109 to be formed, whereas the base of the said rigid sleeve is integral with a ring 104 turned inwardly. A cylindrical skirt 108 slides sealingly in the opening in ring 104, the top of the said skirt comprising a ring 106 which is located above ring 104, and the free outer edge of which slides, in turn and sealingly, on the inside wall of sleeve 101.

The annular chamber defined by the inside wall of sleeve 101, the outside wall of skirt 108, and superimposed rings 104,106 is supplied with fluid under pressure through a line 113. A flexible line 110 is secured to sleeve 101 in such a manner as to communicate with the annular space defined by the rigid sleeve 101 and the sleeve 109 to be formed, the latter being fitted with spacers 109*b* and resting upon a ring 118*a* secured to the top of a cylindrical housing 116. This housing surrounds skirt 108, thus defining a chamber 117 connected to a line 118.

It will be understood that when fluid under pressure is supplied to line 113, mobile assembly 101-102-104 is caused to move downwardly, line 118 communicating with the outside atmosphere or with the hydraulic-system tank. If, at the same time, the hydroforming liquid, in the circuit associated with line 110, is suitably regulated, a bellows will be formed in the manner indicated in FIG. 2. Removal of the bellows at the conclusion of the hydroforming operation may be facilitated by pressurizing chamber 117 with compressed air or oil through line 118, thus causing the said mobile assembly to move back to the top of the apparatus.

In any case, the circuits associated with line 113, on the one hand, and with line 110, on the other hand, are separated from each other, since the first is concerned only with the inside wall of sleeve 101, and the second with the outside wall thereof, and any unwanted interference is thus eliminated. Furthermore, the same apparatus may be used to produce bellows of slightly different diameters, since thickness liners 119 in FIG. 2 may be fitted to sleeve 101.

Figure 3:
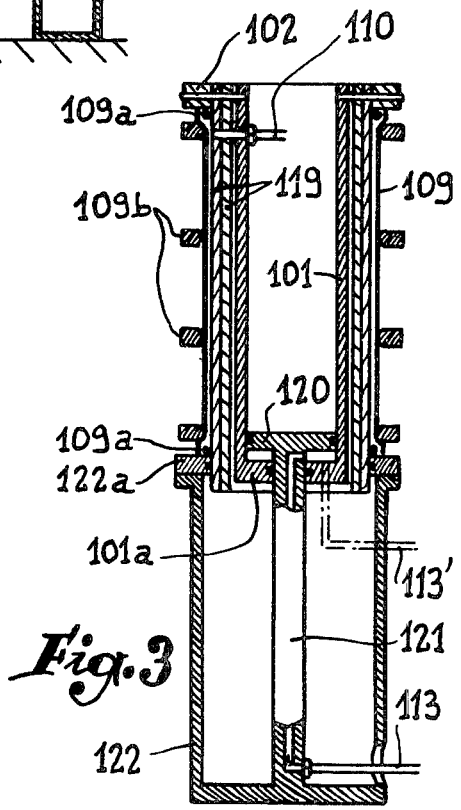
FIG. 3 is a diagrammatic illustration of a variant.

FIG. 3 illustrates a variant intended more particularly for the production of smaller-diameter bellows. In this case, sleeve 101, the base of which is integral with an annular bottom 101*a* taking the place of ring 104, contains a sliding piston 120 carried by a vertical support 121, the base of which is supported by the bottom of housing 122 carrying a ring 122*a* constituting a support for the base of sleeve 109 which is to be formed. Line 113, which supplies fluid under pressure, enters through bottom 101*a* and piston 120 may have an axial duct in support 121, or a duct 113′ passing through bottom 101*a*.

Figure 2:
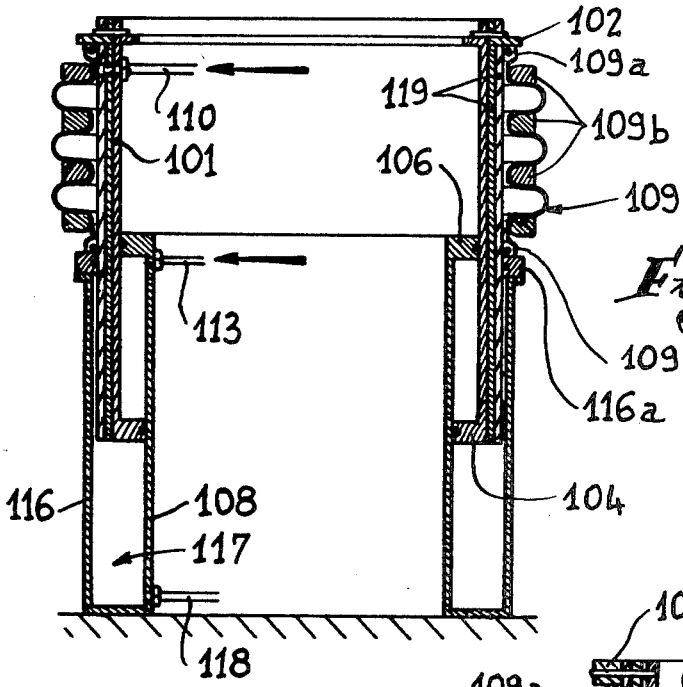
FIG. 2 shows the apparatus in FIG. 1 at the conclusion of the hydroforming operation, the rigid sleeve being adapted to produce bellows of different diameters by fitting thickness liners.

In any case, the method of operation is the same as that described in conjunction with FIGS. 1 and 2. Circuits 110 and 113 are separated from each other, and sleeve 101 may be fitted with thickness liners 119, so that bellows of slightly different diameters may be produced on the same apparatus. It will be observed that if sleeve 101 is closed off at the top, pressurized fluid may be supplied in the same way as through line 118 in FIGS. 1 and 2, for the purpose of causing the mobile assembly to move back again to its starting position.

I claim:

1. An apparatus for longitudinally contracting deformable sleeves by the hydroforming process to manufacture expansion bellows for pipelines and the like, said apparatus comprising:

a movable rigid sleeve having an inwardly turned lower portion and being positionable inside a deformable sleeve to be contracted;

means cooperating with said rigid sleeve and the deformable sleeve for defining a hydroforming circuit between the outer surface of said rigid sleeve and the inner surface of the deformable sleeve to be contracted; and means positioned inside said rigid sleeve for defining an actuating circuit separate from said hydroforming circuit, the actuating circuit being adapted to cooperate with interior portions of said rigid sleeve to longitudinally move said rigid sleeve from a first position in which a first predetermined portion of said rigid sleeve is encompassed by said deformable sleeve to a second position in which a portion less than the first predetermined portion is encompassed by said deformable sleeve, movement of said rigid sleeve from said first to said second position longitudinally contracting the deformable sleeve.

2. An apparatus for the manufacture of expansion bellows from deformable sleeves by the hydroforming process, said apparatus comprising:

a movable rigid sleeve positionable inside a deformable sleeve to define an annular chamber therebetween;

means for defining a hydroforming circuit between the outer surface of said rigid sleeve and the deformable sleeve and including said annular chamber;

support means for supporting said rigid sleeve for longitudinal movement; and means cooperating with an inwardly turned portion of the inner surface of said rigid sleeve for defining an actuating circuit separate from the hydroforming circuit, the actuating circuit including an interior portion of said rigid sleeve and being adapted to longitudinally move said rigid sleeve so that the deformable sleeve is longitudinally contracted to form the bellows.

3. An apparatus according to claim 2, wherein said support means comprises a stationary cylindrical skirt, and a housing radially spaced from and surrounding the cylindrical skirt, the housing having an upper edge for supporting one of the ends of the sleeve to be deformed.

4. An apparatus according to claim 3, characterized in that the skirt and the housing define an annular chamber connected to a source of pressure in such a manner as to ensure the return of the rigid sleeve to an initial position at the conclusion of a forming operation.

5. An apparatus according to claim 2, further comprising at least one thickness liner fitted around the outer wall of the rigid sleeve for producing bellows of different diameters.

6. An apparatus according to claim 2, characterized in that the cooperating means includes a ring arranged within the rigid sleeve in the form of a piston having a fixed support at its end spaced from the rigid sleeve.

* * * * *